US008668489B2

(12) United States Patent
Chiappetta et al.

(10) Patent No.: US 8,668,489 B2
(45) Date of Patent: Mar. 11, 2014

(54) RACETRACK CARRYOVER DESIGN FOR MULTI-BURNER IGNITION IN INDUCED DRAFT HEATING SYSTEM

(75) Inventors: Louis Chiappetta, South Windsor, CT (US); Scott A. Liljenberg, Wethersfield, CT (US); Meredith B. Colket, Simsbury, CT (US); Shiling Zhang, East Hartford, CT (US)

(73) Assignee: Carrier Corporation, Farmington, CT (US)

( * ) Notice: Subject to any disclaimer, the term of this patent is extended or adjusted under 35 U.S.C. 154(b) by 202 days.

(21) Appl. No.: 13/196,418

(22) Filed: Aug. 2, 2011

(65) Prior Publication Data

US 2012/0052452 A1 Mar. 1, 2012

Related U.S. Application Data

(60) Provisional application No. 61/379,112, filed on Sep. 1, 2010.

(51) Int. Cl.
*F24H 3/02* (2006.01)

(52) U.S. Cl.
USPC ..... 431/12; 431/182; 431/278; 431/354; 126/116 R; 126/110 C

(58) Field of Classification Search
USPC ..... 431/12, 182, 278, 326, 328, 329, 354; 126/116 R, 116 A, 116 B, 110 A, 110 C, 126/110 D, 110 R
See application file for complete search history.

(56) References Cited

U.S. PATENT DOCUMENTS

| | | | | |
|---|---|---|---|---|
| 2,808,047 | A * | 10/1957 | Jaye et al. | 126/116 R |
| 4,776,320 | A * | 10/1988 | Ripka et al. | 126/99 A |
| 6,004,129 | A * | 12/1999 | Carbone et al. | 431/354 |
| 6,283,115 | B1 | 9/2001 | Dempsey et al. | |
| 6,860,734 | B2 | 3/2005 | Zia et al. | |
| 2004/0253559 | A1 * | 12/2004 | Schultz et al. | 431/354 |

* cited by examiner

*Primary Examiner* — Alfred Basichas
(74) *Attorney, Agent, or Firm* — Miller, Matthias & Hull LLP

(57) ABSTRACT

An ignition system for a multi-burner heat exchanger assembly, a furnace, and a method using same are disclosed. The assembly may include a plurality of adjacent heat exchanger tubes, with a burner associated with each tube. All the burners may be lit with a single igniter and no source of secondary air. To do so, each of the burners may be provided so as to generate a swirling exit flow of combustion gases. One or more carryover tubes may also be connected between adjacent pairs of heat exchanger tubes or adjacent pairs of burners. The swirling flow generated by the burners causes hot combustion gases to move through the carryover tubes to thus carry the flame from one burner to the next. Not only can a single igniter be used, but a single flame sensor as well, while at the same time reducing nitrogen oxide emissions.

18 Claims, 3 Drawing Sheets

RACETRACK CARRYOVER DESIGN FOR MULTI-BURNER IGNITION IN INDUCED DRAFT HEATING SYSTEM

CROSS-REFERENCE TO RELATED APPLICATIONS

This is a non-provisional U.S. patent application, which claims priority under 35 U.S.C. §119(e) to U.S. Provisional Patent Application Ser. No. 61/379,112 filed on Sep. 1, 2010, the entirety of which is incorporated by reference herein.

TECHNICAL FIELD OF THE DISCLOSURE

The present disclosure generally relates to gas burners and, more particularly, relates to ignition systems for gas burners.

BACKGROUND OF THE DISCLOSURE

Gas burners are widely used in furnaces, boilers and other heating apparatuses used to generate heat for residential and commercial use. Such burners come in myriads of designs, but at their core, they all serve the basic function of igniting gas (typically natural gas) and air, and directing the resulting combustion gases to a heat exchanger. The combustion gases are at an elevated temperature and by directing those through serpentine conduits provided as part of the heat exchanger, the heat exchanger coils are heated. Air to be heated can then be directed across the heat exchanger coils to extract that heat. The heated air can then be communicated through ductwork to the rooms or space needing to be heated.

Typically, the air and gas is ignited by an igniter provided within or immediately aft of the burner. Modern furnaces, however, often include multiple burners with one being associated with each conduit of the heat exchanger. Alternatively, for efficiency purposes, a separate igniter may not be provided with each burner, but rather only one burner may include an igniter, and once that burner achieves combustion, the resulting flame is communicated or transferred to adjacent burners.

The current industry standard for holding and stabilizing the flame is referred to as an "in-shot" burner. The in-shot burner uses a small channel between flameholders to enable a small flame to transfer sufficient heat to light each successive burner. While effective, such prior art burners require a secondary air gap between the in-shot burner outlet and an inlet to the heat exchanger. Current environmental regulations and consumer demands, however, are requiring increasingly stringent burner emissions, including nitrogen oxide ($NO_x$) emissions. In order to meet those reduced emission standards, that secondary air gap must be eliminated, and thus so too must the in-shot burner approach. Fully pre-mixed burners allow for combustion without a secondary air source at the igniter, but there is currently no way to transfer ignition between burners.

Accordingly, a need exists for a mechanism and method for lighting successive burners in a multi-burner heat exchanger assembly using a fully premixed heating system.

SUMMARY OF THE DISCLOSURE

In accordance with one aspect of the disclosure, a multi-burner heat exchanger assembly is disclosed, which may comprise a plurality of heat exchanger tubes, a plurality of burners, one of the plurality of burners being associated with each of the heat exchanger tubes, each of the plurality of burners creating a swirling flow of combustion gases, a primary source of air associated with the plurality of burners where each burner receives substantially all of the air needed for combustion from the primary source of air, and an igniter associated with only one of burners, with the single igniter being adapted to ignite each of the burners.

In accordance with another aspect of the disclosure, a method of igniting multiple burners of a heat exchanger assembly is disclosed, which may comprise providing a plurality of heat exchanger tubes, positioning a plurality of burners proximate the plurality of heat exchanger tubes, each of the burners being adapted to direct combustion gases into one of the plurality of heat exchanger tubes, associating a primary air source with the plurality of burners, each of the burners receiving substantially all air needed for combustion from the primary source of air, and igniting the plurality of burners with a single igniter.

In accordance with another aspect of the disclosure, a heating device is disclosed, which may comprise a heat exchanger having a plurality of adjacent heat exchanger tubes, a plurality of burners, each burner having an outlet connected to an inlet of one of the heat exchanger tubes, each burner premixing air and gas prior to combustion, a primary source of air providing substantially all air needed for combustion, a single igniter in operative association with one of the plurality of burners, an air blower adapted to direct a flow of air across the heat exchanger, the air being heated thereby and communicated to a space to be heated, and a cabinet enclosing the heat exchanger, plurality of burners, igniter and air blower.

These and other aspects and features of the present disclosure will be more readily understood in light of the following detailed description when taken in conjunction with the accompanying drawings.

DETAILED DESCRIPTION

Figure 1:
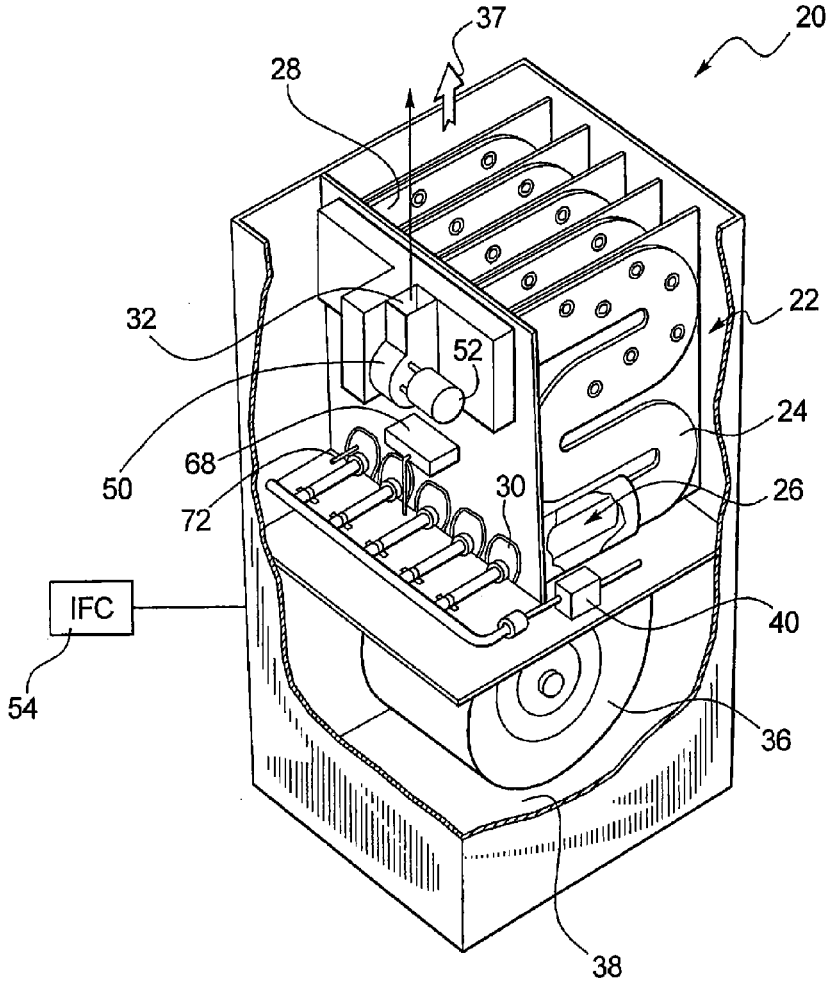
FIG. 1 is a cut-away perspective view of a furnace, in accordance with at least some embodiments of the present disclosure.

Referring now to the drawings, and with specific reference to FIG. 1, a furnace is generally referred to by reference numeral 20. While described herein primarily in conjunction with a furnace, it is to be understood the burner disclosed can be used in additional settings as well, including but not limited to, other heating devices such as boilers, residential packaged products, commercial roof-top units and other heat generation equipment.

The furnace 20 may include a heat exchanger 22 having a plurality of individual heat exchanger coils 24. The heat exchanger coils 24, which may be metallic conduits, may be provided in a serpentine fashion to provide a large surface area in a small overall volume of space, the importance of which will be discussed in further detail below. Each heat exchanger coil 24 includes an inlet 26 and an outlet 28. A burner 30 is operatively associated with each inlet 26, and a vent 32 is operatively associated with each outlet 28. The burner 30 introduces a flame and combustion gases 34 (FIG. 3) into the heat exchanger coil 24, while the vent 32 releases the combustion gases 34 to the atmosphere (through a flue or the like) after the heat of the flame and combustion gases 34 is extracted by the heat exchanger 22.

In order to extract that heat, a blower motor 36 may be provided to create significant air flow across the heat exchanger coils 24. As the air circulates across the heat exchanger coils 24, it is heated and can then be directed to a space to be heated such as a home or commercial building by way of appropriate ductwork as indicated by arrow 37. The furnace 20 may also include a return 38 to enable air from the space to be heated to be recirculated and/or fresh air to be introduced for flow across the heat exchanger coils 24.

To generate the flame and hot combustion gases 34, the burners 30 pre-mix fuel and air and ignite the same. The fuel may be natural gas or propane and may be introduced by a fuel orifice or jet 42 (FIG. 3) positioned at an inlet 44 to the burner 30. The burner 30 may include a burner tube 46 having the inlet 44 and an outlet 48. Substantially all air necessary for combustion may also be introduced into the burner 30 through the inlet 44, as indicated by primary air source 49. Such air may be introduced by inducing an air flow using a motorized induction fan 50 downstream of the burner outlet 48. More specifically, a motor 52 having the fan 50 associated therewith may be operatively associated with the outlets 28 of the heat exchanger coils 24. When energized, the fan 50 may rotate and induce an air flow pulling air from the primary source of air 49 through the heat exchanger coils 24 and burners 30. Control of the motor 52, as well as the motor 36, may be controlled by a processor 54 such as an integrated furnace control (IFC). The motors 36 and 50 may be variable speed motors adapted to rotate at differing velocities as dictated by signals received from the IFC 54.

Figure 2:
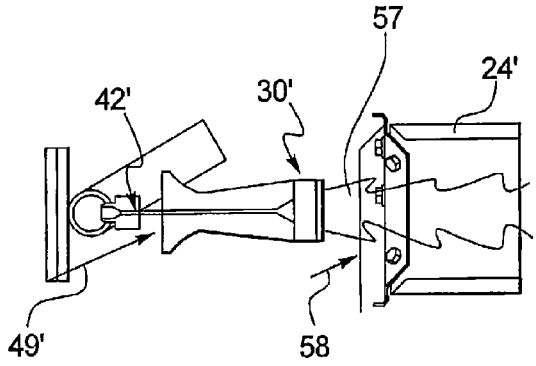
FIG. 2 (PRIOR ART)
FIG. 2 is a sectional view of a burner constructed in accordance with a prior art design utilizing an in-shot ignition system.
Figure 3:
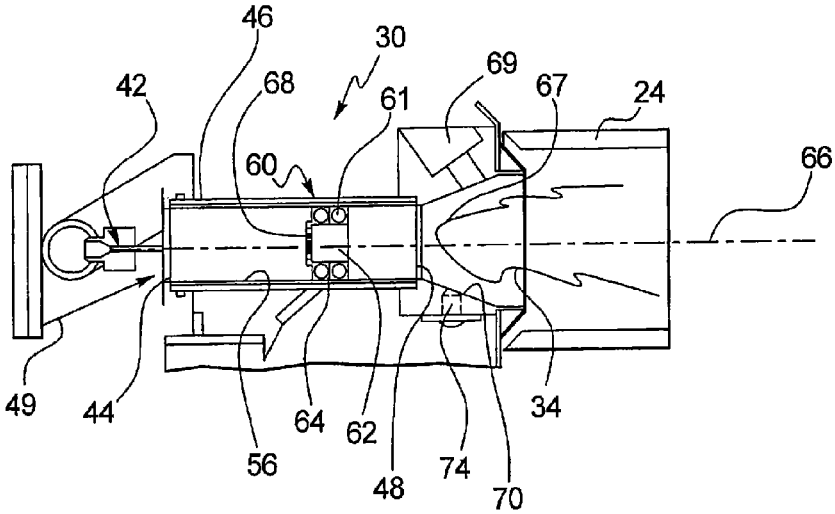
FIG. 3 is a sectional view of a burner and heat exchanger assembly constructed in accordance with the teachings of the present disclosure.

Referring now to FIG. 3, the burner 30 is shown in more detail. As indicated above, the burner 30 may include the burner tube 46 having the inlet 44 and the outlet 48, but can be provided in other configurations as well. For example, while depicted as a cylindrical tube of constant diameter, the burner tube 46 may be provided as a restricted diameter section or a venturi, among other variations. The inlet 44 may also serve as and define a mixing chamber 56. In order to reduce $NO_x$ emissions, the fuel and air must be premixed prior to ignition. Accordingly, the fuel nozzle 42 and induction motor 52 may be provided at the inlet 44 to mix the fuel and air prior to ignition. As indicated above, substantially all air necessary for combustion may be provided by the primary air source 49, with no source of secondary air being provided. This is a significant departure from prior art burners such as that depicted in FIG. 2. As shown therein, an air gap 57 exists between burner 30' and heat exchanger coil 24'. While this air gap 57 provides secondary air 58 in addition to primary air 49' to support stable ignition, it also results in increased $NO_x$ emissions, for a burner operating at the same overall fuel-to-air ratio.

As indicated above, in order to reduce such $NO_x$ emissions, the present disclosure removes the air gap 57 and uses an induced draft system to provide sufficient air for combustion. In order to provide a stable flame 34 in such a system, the burner 30 may further include a mechanical swirler 60. As shown in FIG. 3, the swirler 60 may include an annular plenum 61 surrounding a central passageway 62. The plenum 61 may include a plurality of vanes 64 provided at an angle relative to a longitudinal axis 66 of the burner 30. In so doing, the premixed air and fuel flowing through the annular plenum 61 may be deflected by the vanes 64. A tangential or rotational vector is therefore introduced to the flow of the mixed air and fuel. In combination with the mixed air and fuel flowing through the central passageway 62, this creates an exiting plume 67 of fuel and air that may be controlled and results in a stable flame 34. The central passageway 62 may be provided with a flow restrictor 68 to create a pressure drop from the inlet 44 to the outlet 48. The pressure drop thereby created discourages flow through the central passageway 62 and facilitates greater flow through the annular plenum 61. The flow restrictor 68 may be provided in the form of a wire mesh, screen or filter, or the aforementioned venturi, with the level of restriction being selected to result in the flame characteristics desired. It is to be understood that the aforementioned swirler 60 is merely exemplary and other forms of low-pressure-drop burners are possible as well.

Upon exit from the swirler 60, the plume 67 of mixed air and fuel is ready for ignition. One option would be to provide an igniter with each burner 30, but this adds significant expense and maintenance. The option afforded by the prior art, i.e, using the in-shot burner mentioned above, where the inlets to the heat exchangers are not enclosed and secondary air is able to be communicated between all the burners and heat exchanger inlets to thus carry the flame from one burner to the next, is also not an option.

The present disclosure therefore departs from the prior art in this regard as well. As the connection between the burner outlet and the heat exchanger inlet in an induced draft furnace must remain sealed to reduce NOx emissions, the present disclosure provides a mechanism by which a single igniter 69 may be used to ignite one burner 30, and then that ignition can be carried over to each of the burners 30 in succession. In the depicted embodiment, the igniter 69 is provided within a flame expansion zone 70 of the heat exchanger coil 24 so as to be proximate the air and fuel plume 67 created by the swirler 60.

Figure 4:
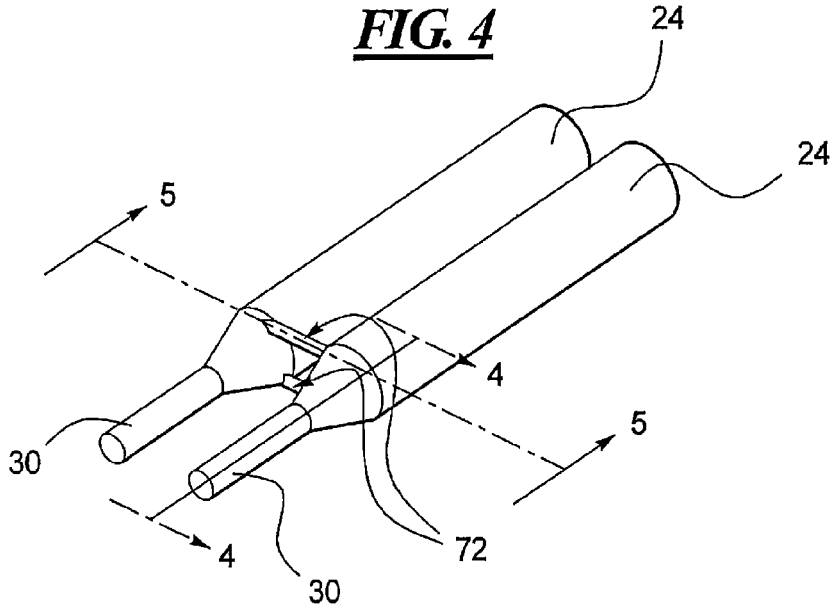
FIG. 4 is a perspective view of two of the burners of FIG. 3, together with initial sections of adjoining heat exchanger tubes.

Referring now to FIG. 4, it will be noted that the adjacent heat exchanger coils 24 may be connected by one or more carryover tubes 72. In the depicted embodiment, two such carryover tubes 72 are provided between each adjacent pair of heat exchanger coils 24, but it is to be understood that in alternative embodiments only one may be used, more than two may be used, the carryover tubes could be provided between adjacent pairs of burners, and that shapes and arrangements other than cylindrical tubes may be used to connect the adjacent coils 24. For example, in alternative embodiments, the heat exchanger coils 24 need not be provided in a linear array as depicted, but could be provided in a connected loop such as a circular or rectangular configuration, or the like. In such arrangements, a single carryover tube 72 can be used between each adjacent pair of coils 24.

The carryover tubes 72 provide a mechanism by which the flame or hot combustion gases of one burner 30 can be communicated to an adjacent burner 30 to ignite same. In turn, once that burner 30 is ignited the subsequent set of adjacent carry over tubes 72 can be used to ignite the next burner 30 and so on. In so doing, the single igniter 69 can be used to ignite all of the burners 30. Accordingly, the expense of providing individual igniters 69 for each burner 30 is avoided. This not only saves on initial manufacturing costs but on maintenance costs as well.

Figure 5:
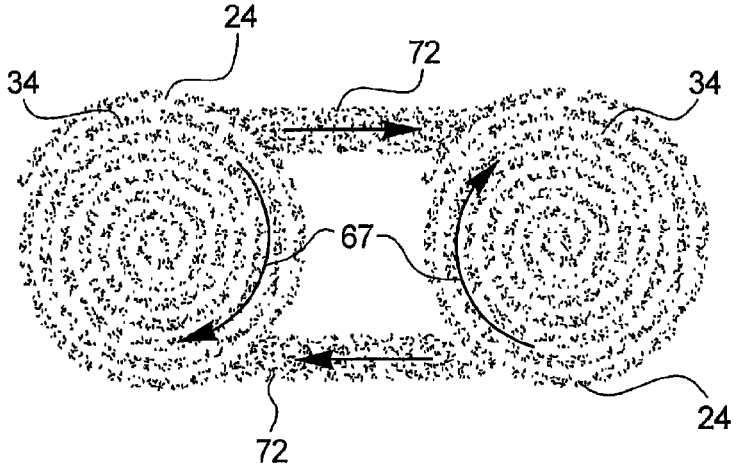
FIG. 5 is a fluid flow schematic of the swirling flames and combustion gases being communicated between adjacent burners using carryover tubes according to the teachings of the present disclosure, and taken generally along line 5-5 of FIG. 4.

The manner in which the ignition may be carried over from burner to burner is best conveyed by way of the fluid flow schematic of FIG. 5. As shown therein, the output plume 67 of each burner 30 rotates due, in part, to the swirler 60. This rotation is also assisted by the relative pressure drop between ignited and un-ignited burners. More specifically, upon ignition of one burner, there is a pressure rise in the ignited burner, thereby causing hot combustion gases to flow to the lower pressure, non-ignited burners adjacent thereto.

In the depicted embodiment, the output plume 67 rotates clockwise, but it is to be understood that in alternative embodiments the rotation could be counter-clockwise or any combination of the two. Once the plume 67 is ignited by the igniter 69 to form flame the 34, the flame and combustions gases 34 continue to rotate in a clockwise direction. If not for the carryover tubes 72, that rotating or swirling vortex of combustion gases would simply navigate down the heat exchanger coil 24. However, by providing at least one carryover tube 72, a portion of those hot combustion gases is communicated through the carryover tube 72 to the adjacent coil 24 and burner 30. The heat of the combustion gases is therefore sufficient to ignite the mixed fuel and air plume 67 exiting from the burner 30. In turn, once burner 30 is ignited, its flame and combustion gases 34 rotate in a counterclockwise direction. Given the rotational vector of that plume 67, a portion of the hot combustion gases is again communicated through the next carryover tube 72 to ignite the next burner 30 and so on until each of the burners 30 is ignited.

As indicated above, the second set of carryover tubes 72 is not entirely necessary, but does facilitate cascading action by providing a pressure differential between all the burners, thereby fostering a clockwise motion of the combustion gases through the burners 30 as a whole. Of course, if the swirler 60 is designed to create a counterclockwise rotation of combustion gases 34, the carryover tubes 72 enable overall counterclockwise flow as well. As the carryover tubes 72 allow each of the burners 30 to be in fluid communication with one another, a single flame sensor 74 can be used as well. By providing a single flame sensor 74, the presence of a flame 32 at the point of sensing can be detected with a signal associated therewith being transmitted back to the processor 54 as an indication that flames 34 are present with each of the burners 30. This flame sensing can be effectively performed by providing the flame sensor 74 at the burner furthest removed from the igniter 69 so as to ensure that all intermediate burners there between are ignited.

Industrial Applicability

From the foregoing, it can be seen that the technology disclosed herein has industrial applicability in a variety of settings such as, but not limited to heating devices such as gas powered furnaces and boilers, as well as other heating equipment, such as residential packaged products and commercial roof-top units. By providing gas burners in an induced draft system without a secondary source of air, the flame equivalence ratios are controlled and thereby the $NO_x$ emissions of the burners are reduced. Moreover, by providing a swirler in the burner, the flame created by the burner, even in an induced draft system, is stable. Finally, by providing carryover tubes between adjacent heat exchanger coils, a single igniter can be used to ignite one burner with that flame then being carried over to each successive burner to ignite all the burners with a single igniter. A single flame sensor can be used as well.

It is to be understood the aforementioned disclosure is by way of example only, and that other variations and embodiments, are encompassed within the spirit and scope of the present disclosure as defined by the appended claims.

What is claimed is:

1. A multi-burner heat exchanger assembly, comprising:

a plurality of heat exchanger tubes;

a plurality of burners, each of the plurality of burners being associated with one of the heat exchanger tubes, each of the burners creating a swirling flow of combustion gases;

a primary source of air associated with the plurality of burners, each of the plurality of burners including a mechanical swirler; and a single igniter associated with the plurality of burners, the single igniter being adapted to ignite each of the burners.

2. The multi-burner heat exchanger assembly of claim 1, further including at least one carryover tube connected between each adjacent pair of heat exchanger tubes or each pair of adjacent burners.

3. The multi-burner heat exchanger assembly of claim 2, further including a second carryover tube connected between each adjacent pair of heat exchanger tubes or each pair of adjacent burners.

4. The multi-burner heat exchanger assembly of claim 1, further including only one flame sensor.

5. The multi-burner heat exchanger assembly of claim 1, wherein the mechanical swirler includes an annular plenum surrounding a central passageway.

6. The multi-burner heat exchanger assembly of claim 5, wherein the annular plenum further includes a plurality of angularly disposed vanes.

7. A method of igniting multiple burners of a heat exchanger assembly, comprising:

providing a plurality of heat exchanger tubes;

positioning a plurality of burners proximate the plurality of heat exchanger tubes, each of the plurality of burners being adapted to direct combustion gases into one of the plurality of heat exchanger tubes;

associating a primary air source with the plurality of burners, each of the burners including a mechanical swirler; and igniting the plurality of burners with a single igniter.

8. The method of claim 7, further including first and second carryover tubes between adjacent heat exchanger tubes or adjacent burners.

9. The method of claim 8, wherein each of the plurality of burners produces a swirling output of combustion gases.

10. The method of claim 7, further including sensing the presence of a flame in each of the plurality of burners using a single flame sensor.

11. A heating device, comprising:

a heat exchanger having a plurality of adjacent heat exchanger tubes;

a plurality of burners, each burner having an outlet connected to an inlet of one of the heat exchanger tubes, each burner premixing air and gas prior to combustion, each burner including a mechanical swirler;

a primary source of air;

a single igniter in operative association with the plurality of burners;

an air blower adapted to direct a flow of air across the heat exchanger, the air being heated thereby and communicated to a space to be heated; and a cabinet enclosing the heat exchanger, plurality of burners, igniter and air blower.

12. The heating device of claim 11, wherein the mechanical swirler includes an annular plenum surrounding a central passageway, the mechanical swirler including a plurality of angular vanes, the central passageway including a flow restrictor.

13. The heating device of claim 11, further including at least one carryover tube connecting adjacent pairs of heat exchanger tubes or adjacent pairs of burners.

14. The heating device of claim 13, further including first and second carryover tubes connecting adjacent pairs of heat exchanger tubes or adjacent pairs of burners.

15. The heating device of claim 11, further including only one flame sensor for sensing the presence of a flame in each of the plurality of burners.

16. The heating device of claim 15, wherein the flame sensor is located in a burner furthest removed from the igniter.

17. The heating device of claim 11, wherein the heating device is selected from the group of heating devices consisting of furnaces, boilers, residential packaged products and commercial roof-top units.

18. The heating device of claim 11, further including a motorized fan operatively associated with outlets of the heat exchanges tubes, the motorized fan inducing air flow through the heat exchange tubes.

* * * * *